US006042178A

United States Patent [19]

Hetherington

[11] Patent Number: 6,042,178

[45] Date of Patent: Mar. 28, 2000

[54] FOLDABLE CHAIR

[75] Inventor: Willis John Hetherington, Jilliby, Australia

[73] Assignee: JPM Industries Pty Ltd., New South Wales, Australia

[21] Appl. No.: 09/071,266

[22] Filed: May 1, 1998

[30] Foreign Application Priority Data

May 14, 1997 [AU] Australia ..... PO6788

[51] Int. Cl.[7] ..... A47C 9/06

[52] U.S. Cl. ..... 297/14; 297/334

[58] Field of Search ..... 297/331, 334, 297/335, 14

[56] References Cited

U.S. PATENT DOCUMENTS

| | | |
|---|---|---|
| 1,412,367 | 4/1922 | Noack . |
| 2,192,577 | 3/1940 | Jungerman . |
| 2,806,511 | 9/1957 | Merelis . |
| 3,594,037 | 7/1971 | Sherman . |
| 4,460,215 | 7/1984 | Chamberlain et al. . |
| 4,580,832 | 4/1986 | Maruyama et al. . |
| 4,632,457 | 12/1986 | Hofrichter et al. . |
| 4,902,069 | 2/1990 | Lehnert . |
| 5,101,811 | 4/1992 | Brunswick . |
| 5,364,151 | 11/1994 | Yurasits . |
| 5,791,729 | 8/1998 | McCormick et al. . |

FOREIGN PATENT DOCUMENTS

| | | | |
|---|---|---|---|
| 4135841 | 5/1993 | Germany | 297/335 |
| 1028539 | 7/1983 | U.S.S.R. | 297/334 |

*Primary Examiner*—Milton Nelson, Jr.
*Attorney, Agent, or Firm*—Ladas & Parry

[57] ABSTRACT

A foldable chair (10) includes a support frame having vertical posts (11) and a cross bracket (44). Vertical posts (11) each having two fixing lugs (17) through which threaded fasteners or the like secure the frame to a vertical wall. Feet (43) of each vertical post (11) are intended to sit upon a floor surface such that downward forces are not carried by lugs (17). The chair includes a seat (42) adapted to be folded into a substantially vertical storage orientation. A locking mechanism retains the seat (42) in a substantially horizontal in-use orientation.

13 Claims, 8 Drawing Sheets

FOLDABLE CHAIR

FIELD OF THE INVENTION

The following invention relates to a foldable chair. More particularly though not exclusively, the invention relates to a foldable chair for use in a shower recess by elderly or disabled people.

Elderly or disabled people often have trouble showering and it is known to place a chair in the shower recess upon which such persons can sit whilst showering.

A chair left in the shower recess can be a burden to those not requiring it as it must be removed prior to use of the shower recess by them.

OBJECT OF THE INVENTION

It is the object of the present invention to overcome or substantially ameliorate the above disadvantage and/or more generally to provide a foldable chair for use in such places as a shower recess.

SUMMARY OF THE INVENTION

There is disclosed herein a foldable chair configurable between a folded, substantially unobtrusive configuration to an in-use configuration, said chair including:

a support frame adapted to be secured to a wall, an arm rest pivotally connected to the frame, a seat frame connected to said support frame so as to pivot about a pivot axis which can move linearly along said support frame, an intermediate member pivotally connected to both said arm rest and said seat frame, and a seat frame support member pivotally connected to both said seat frame and said support frame, wherein said seat frame is lockable in one or both of said folded configuration wherein said seat frame is essentially parallel with said support frame and said in-use configuration wherein it is oriented so as to extend substantially normal to said support frame.

Preferably, the foldable chair has a seat fixed to said seat frame and a back rest fixed to said support frame.

Preferably, said support frame has fixing lugs by which the frame can be secured to a wall by threaded fasteners, expanding bolts or the like.

Preferably, said support frame has feet by which it can rest upon a floor such that said threaded fasteners or expanding bolts or the like need not sustain shear stress.

Preferably, a roller is rotatably supported upon said seat frame and is adapted to roll within and engage against internal surfaces of vertical posts forming part of said support frame.

Preferably, two said vertical posts are provided, at least one of which has an elongate track or slot through which an axle of said roller passes from said seat frame to said roller.

Preferably, said intermediate member has a pair of seat frame support members attached to, so as to span laterally between, a pair of parallel and coextensive cross axle members, one of said cross axle members being pivotally connected at its ends to said support frame, the other of said cross axle members being pivotally connected at its ends to said seat frame.

Preferably, the means to provide said lockability of said seat frame is a lock mounted to said support frame and having a striker pin engagable with said seat frame.

Preferably, the means to provide said lockability includes actuator means having a push handle connected thereto by linkages.

Preferably, said linkages include a pair of levers pivotally connected to said support frame and mutually, pivotally interconnected at one of their respective ends to said push handle, the other ends, each being pivotally interconnected to a respective pull rod.

Preferably, each said pull rod is pivotally connected to a lock cam which is associated with said striker pin, pulling of the pull rod causing rotation of said lock cam and movement of said striker pin.

Preferably, the components of said foldable chair are manufactured from 316 stainless steel.

Preferably, said seat and back rest are formed of a PVC acrylic blend, such as that sold under the trade name Kydex.

Preferably, the seat clips onto the seat frame and is removable therefrom for the purpose of cleaning and sanitising.

There is further disclosed herein a foldable chair configurable between a folded, substantially unobtrusive configuration and an in-use configuration, said chair having:

a support frame adapted to be secured to a wall, a seat frame connected to said support frame so as to pivot about a pivot axis, a seat frame support member pivotally connected to the seat frame, and being selectively engageable with a locking lug secured to the support frame so as to retain the seat frame in the in-use configuration, and wherein the seat frame support member is detachable from said locking lug to enable the seat frame to be folded into said substantially unobtrusive configuration.

Preferably, the seat frame support member includes a boss engageable with said locking lug means.

Preferably, associated with the locking lug means is a guide bar defining limits of movement of said boss.

Preferably, the seat clips onto the seat frame and is removable therefrom for the purpose of cleaning and sanitising.

BRIEF DESCRIPTION OF THE DRAWINGS

A preferred form of the present invention will now be described by way of example with reference to the accompanying drawings, wherein.

DETAILED DESCRIPTION OF THE PREFERRED EMBODIMENT

Figure 1:
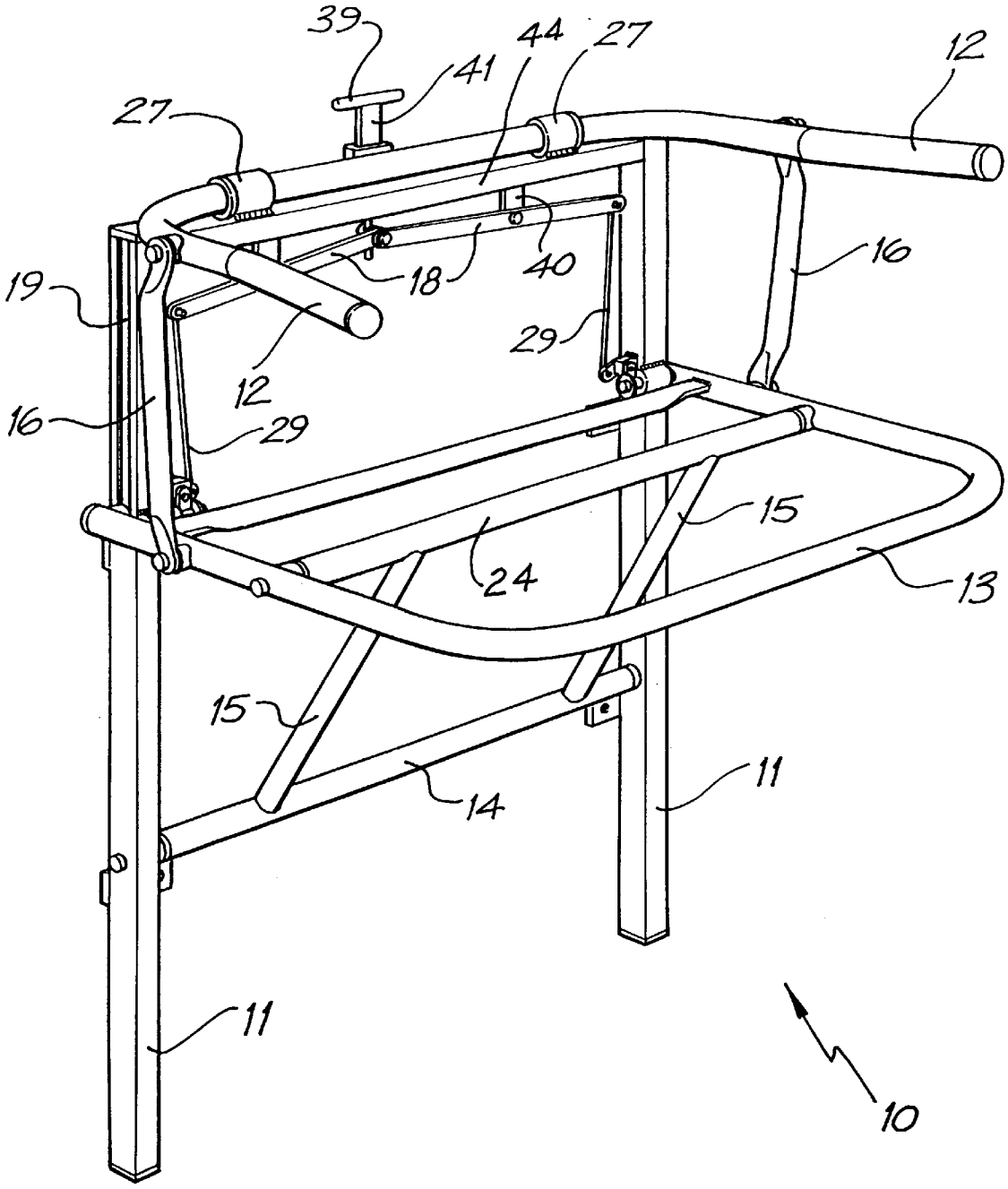
FIG. 1 is a schematic perspective view of a foldable chair.

In FIGS. 1 to 17 of the accompanying drawings there is schematically depicted a foldable chair 10. Foldable chair 10 is typically fabricated from 316 stainless steel which is particularly useful in hospital environments for its non-porous nature where blood for example is readily wiped off its surface. Chair 10 has a support frame having vertical support posts 11 and a cross bracket 44. Vertical posts 11 each have two fixing lugs 17 through which threaded fasteners, expansion bolts or the like can pass for securing the support frame to a vertical wall. Plastic spacers can be positioned between the vertical posts 11 or lugs 17 and the wall to allow any moisture behind the posts to evaporate. The feet 43 of each vertical support post 11 are intended to sit upon a floor surface such that downward forces are not carried by the threaded fasteners or expansion bolts passing through lugs 17.

The cross bracket 44 has welded or otherwise secured thereto a pair of bushes 27 through which back portion 26 of a pair of arm rests 12 can pass so as to pivotally secure the arm rests 12 to the support frame. At the remote distal ends of each arm rest 12, a handle can be provided such as in the form of a handle used on a bicycle for example. Special non-porous handles can be used.

Figure 7:
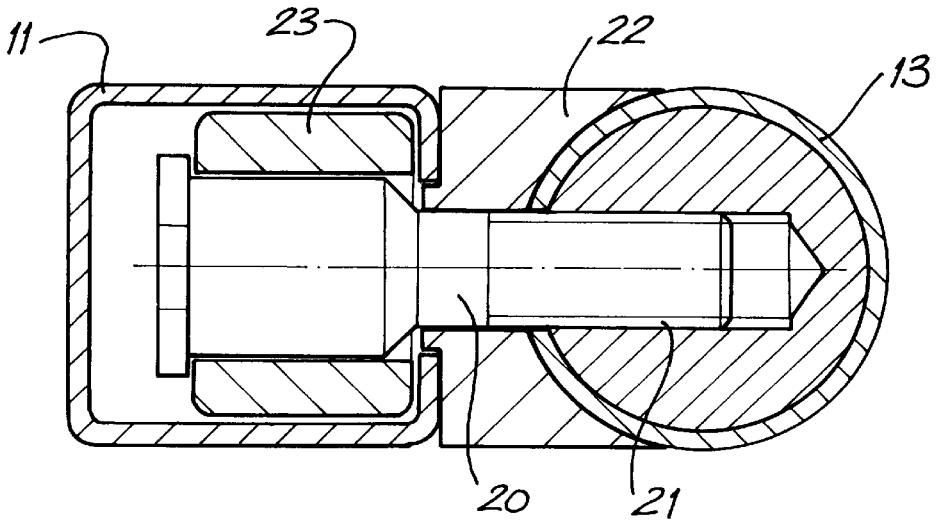
FIG. 7 is a schematic plan cross sectional view of a vertical support post having a roller therein, the roller being connected to a seat support frame member.
Figure 9:
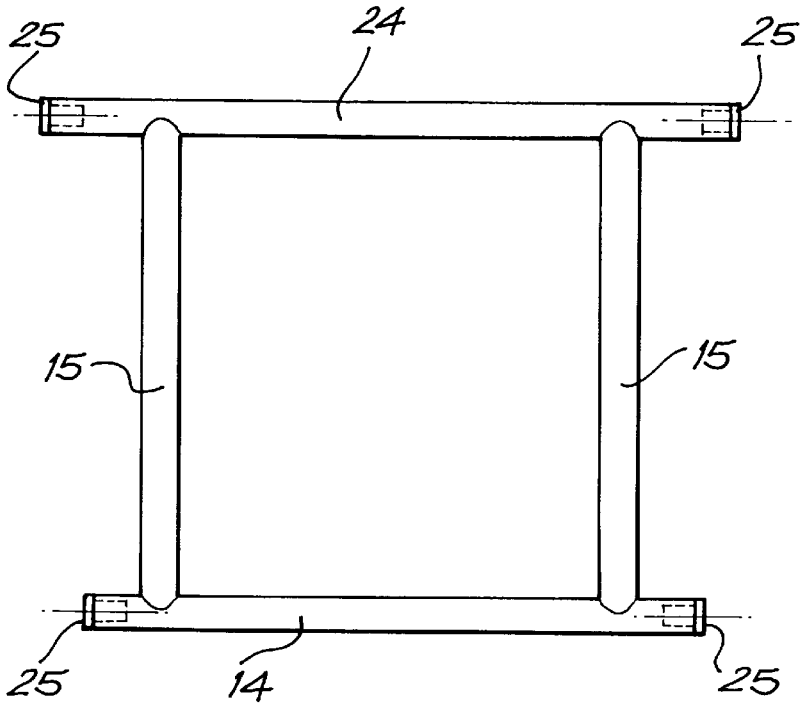
FIG. 9 is a schematic plan view of an intermediate support frame.
Figure 8:
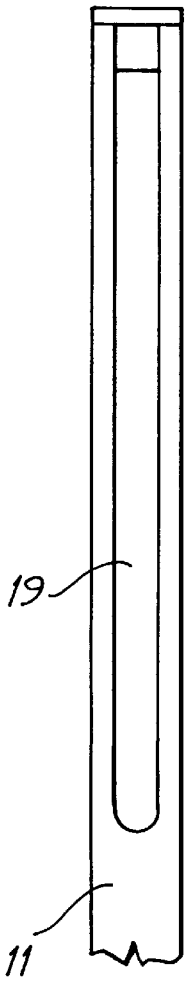
FIG. 8 is a schematic side elevational view of a portion of a vertical support post.
Figure 10:
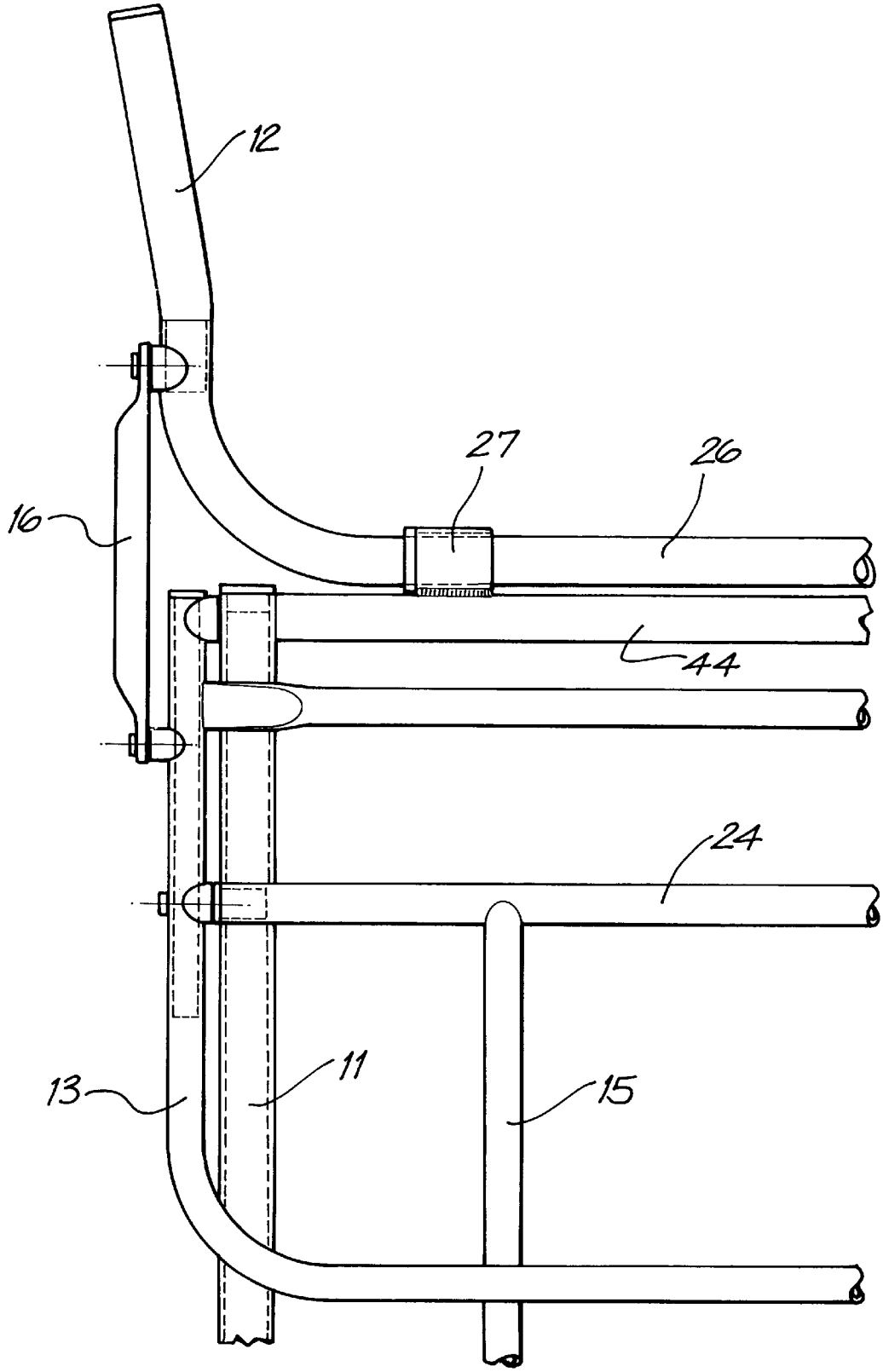
FIG. 10 is a schematic front elevational view of a portion of said foldable chair.
Figure 11:
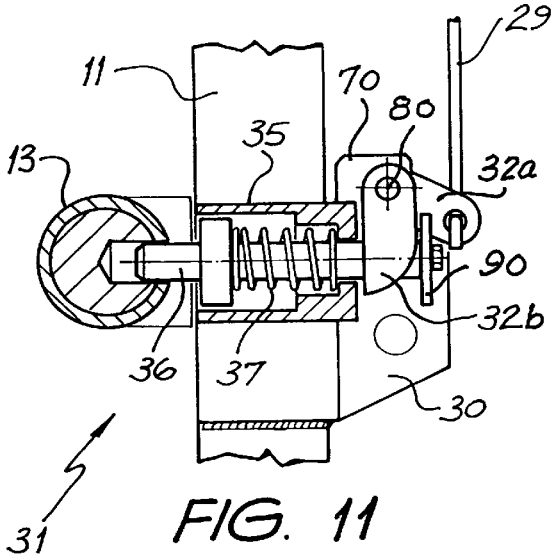
FIGS. 11, 12 and 13 are schematic cross sectional elevational views of a lock adapted to secure the foldable chair in an in-use and/or folded-away configuration.
Figure 12:
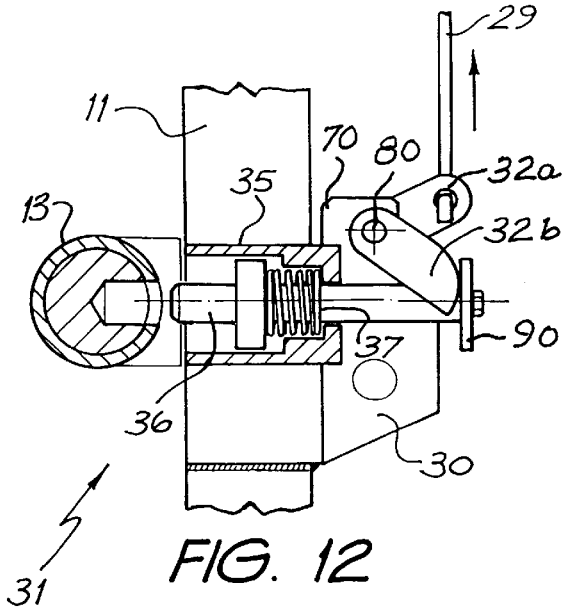
Figure 13:
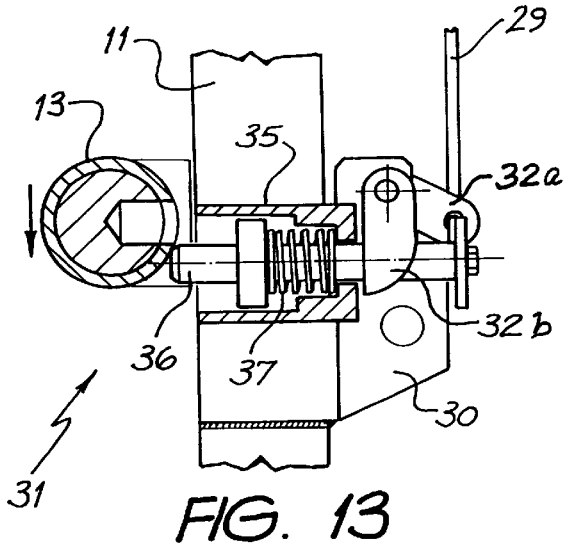

A seat frame 13 is pivotally and slidably mounted to the vertical support posts 11. Each support post 11 has a longitudinal track or slot 19 through which a pin 20 passes. Pin 20 has rotatably mounted thereon a roller 23. As shown in FIG. 7, each vertical post 11 has a hollow square section within which the roller 23 can ride. The other end of pin 27 is threadably secured by means of thread 11 to the seat support frame 13. By the arrangement of FIG. 7, the back edge of the seat frame 13 can both slide vertically along the vertical posts 11 and pivot with respect thereto. Located between the seat frame 13 and the vertical post 11 is a bush 23, typically formed of polyethylene or nylon for example. Interconnected between the seat frame 13 and each arm rest 12 is a respective intermediate member 16. Each member 16 is pivotally interconnected at its ends to the arm rests and seat frame.

Also pivotally connected to the seat frame 13 is a sub-frame having seat frame support members 15 which interconnect a pair of parallel cross axles 14 and 24. Cross axle 14 is pivotally connected at its ends to each vertical support post 11. The other cross axle 24 is pivotally connected at its ends to the seat frame at a position which is spaced further from the posts 11 than the point at which the intermediate members 16 attach to the seat frame.

Figure 14:
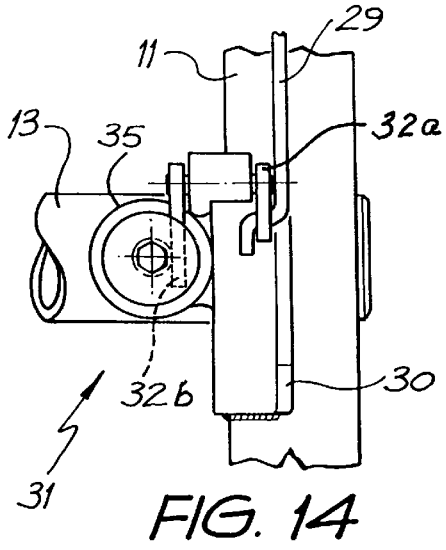
FIG. 14 is a schematic front elevational view of the lock mechanism of FIGS. 11, 12 and 13.
Figure 15:
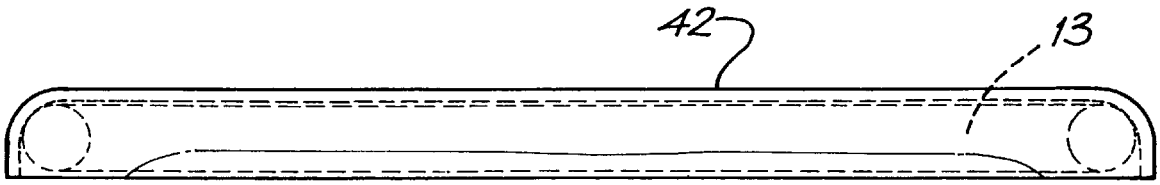
FIG. 15 is a schematic front elevational view of a seat.
Figure 16:
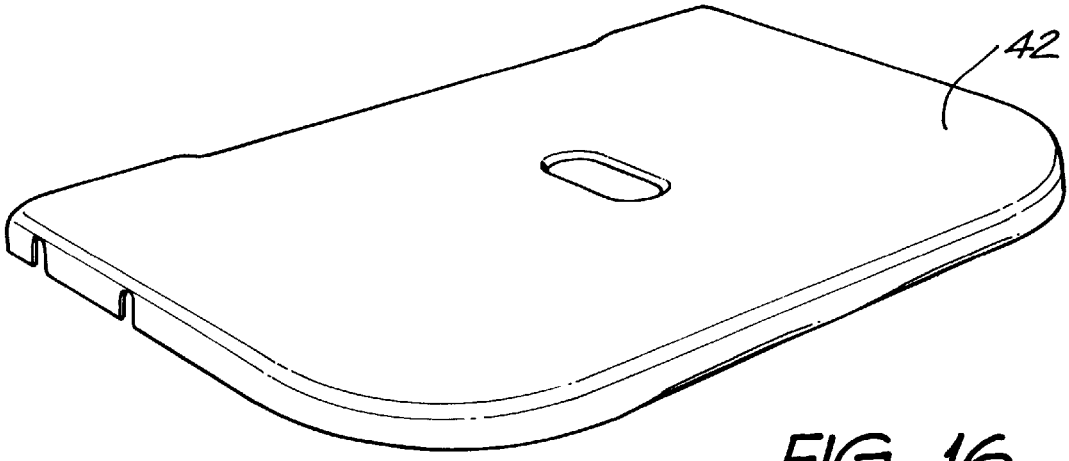
FIG. 16 is a schematic perspective view of the seat of FIG. 15.
Figure 17:
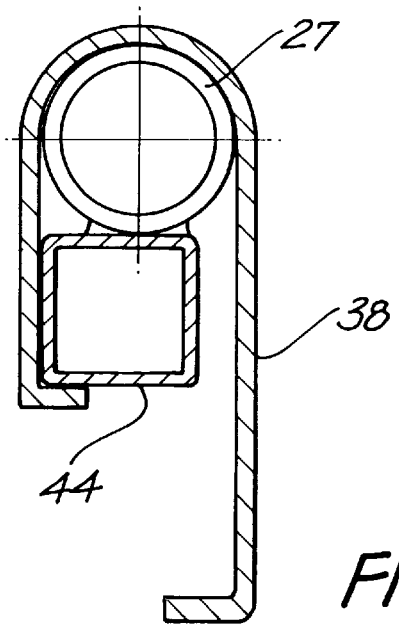
FIG. 17 is a schematic cross sectional side elevational view of a back rest.

FIGS. 11 to 14 show a locking mechanism 31 adapted to retain the seat frame 15 in an in-use configuration wherein it extends essentially normal to the wall. The locking mechanism 31 has a lock housing 35 welded or otherwise secured to a lock support bracket 30. Support bracket 30 is screwed or otherwise secured to the vertical post 11. The lock mechanism 31 is duplicated at each vertical post 11. Through the lock housing 35, a striker pin 36 passes. Striker pin 36 is biased toward and into the seat frame support member 15 by means of a coil spring 37. Situated alongside the striker pin 36 is a mounting plate 70 to which there is pivotally attached a shaft 80. Pivotally fixed to the shaft 80 is a pair of locking cam members 32*a* and 32*b*. Cam member 32*b* bears against a washer 90 affixed to the striker pin 36. The other cam member 32*a* is affixed to the lower end of pull rod 29 such that upon pulling the cam member 32*a* upwardly, both cam members 32*a* and 32*b* rotate about shaft 80 such that cam member 32*b* upon its interaction with washer 90 draws the striker pin 36 against the resilient action of coil spring 37. Once pin 36 is thus withdrawn from support member 13, the seat can be folded away. This arrangement is best shown in FIG. 14.

Pull rods 29 extend upwardly from the lock cams 32*a*, 32*b* to respective ends of a pair of levers 18. Levers 18 are each pivotally connected at their respective intermediate portions to a respective pivot lug 40 upon cross bracket 44. The proximal ends of levers 18 are mutually interconnected to a push bar 41 at the top of which there is secured a push handle 39.

A seat 42, typically formed of a PVC acrylic blend material is molded so as to conform at its edges with the shape of the seat frame 13. The seat 42 can be clipped onto the seat frame 13 by means of recesses which resiliently deform and clip over the side members of the seat frame 13. This will enable the seat 42 to be removed without tools from the seat frame 13 for the purpose of santising and cleaning.

A back rest 38, also typically formed of molded PVC acrylic blend is adapted to conform around the back portion 26 of arm rests 12. The back rest 38 is connected with the cross bracket 44.

Figure 2:
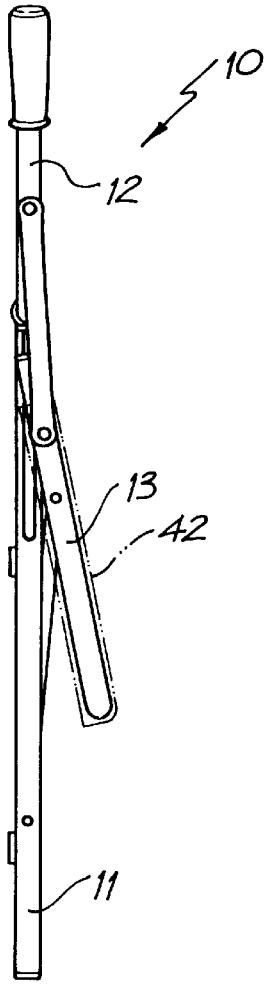
FIGS. 2, 3 and 4 are schematic perspective views of the chair of FIG. 1 in a sequence of stages of reconfiguration.
Figure 3:
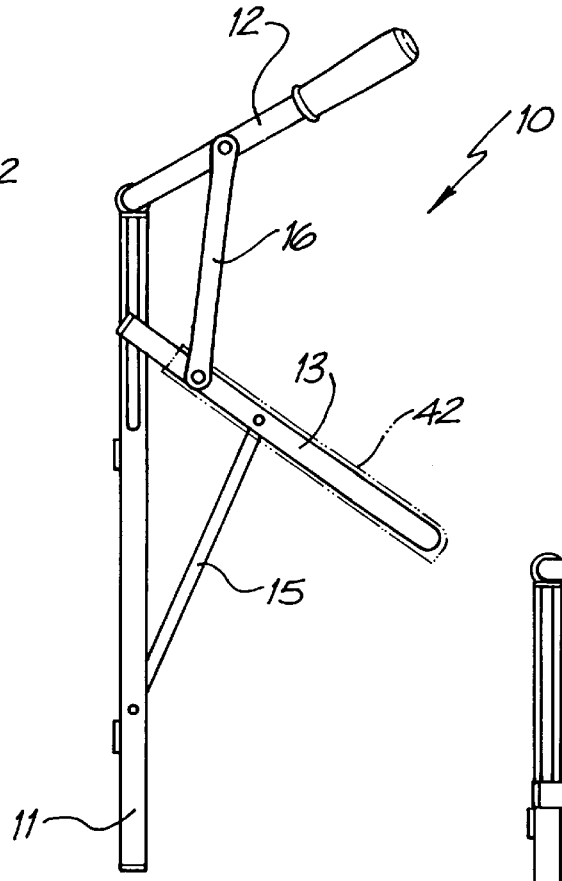
Figure 4:
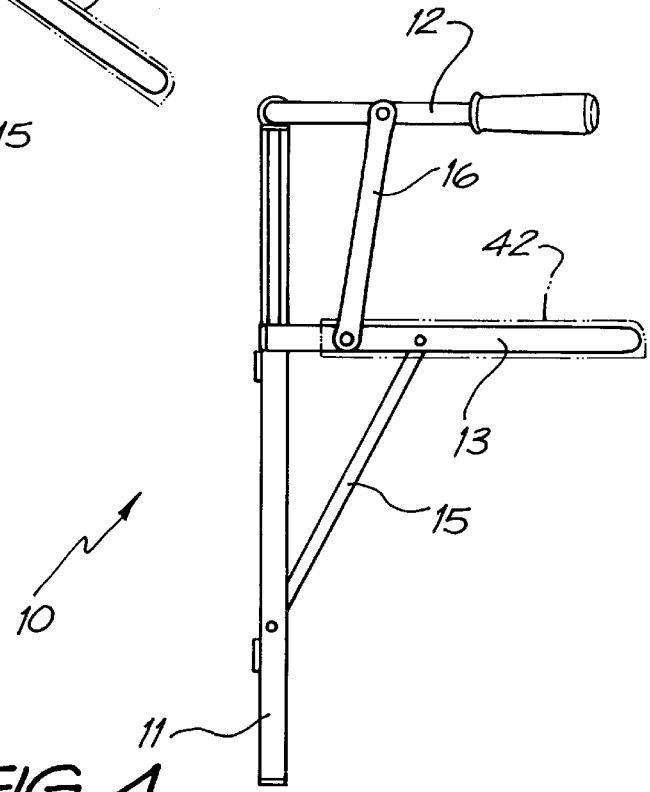
Figure 5:
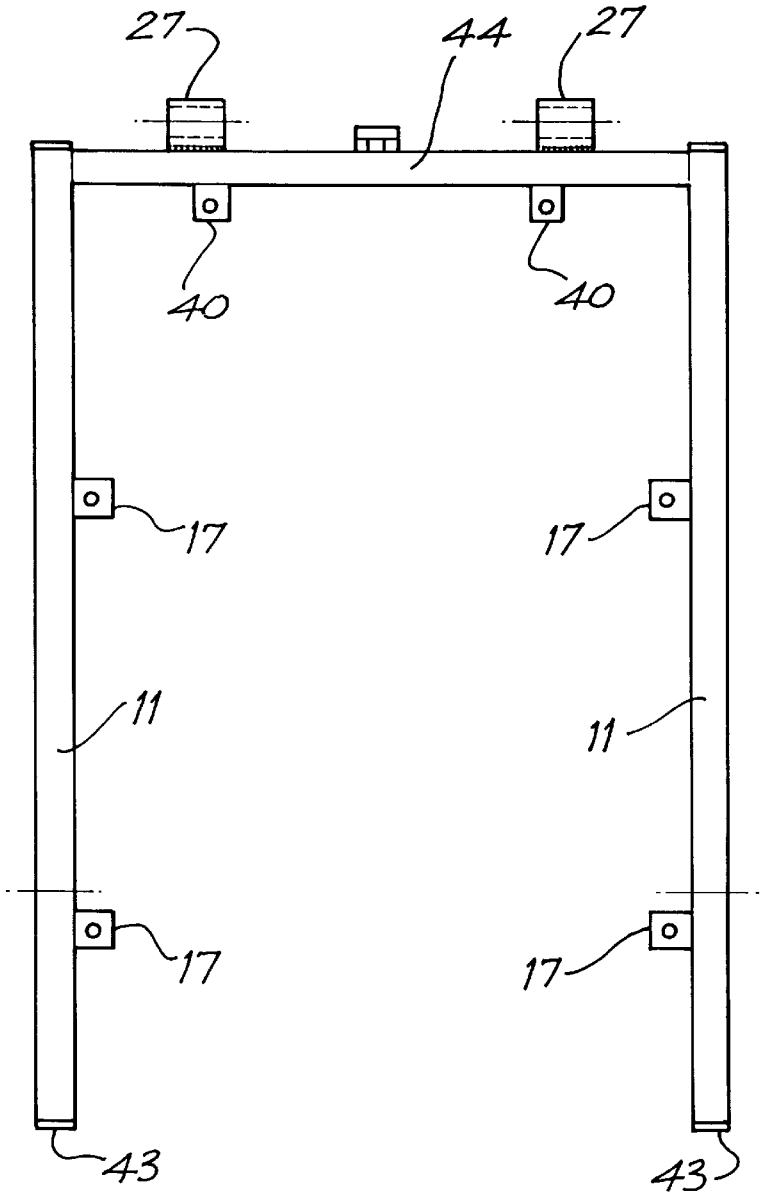
FIG. 5 is a schematic front elevational view of a support frame.
Figure 6:
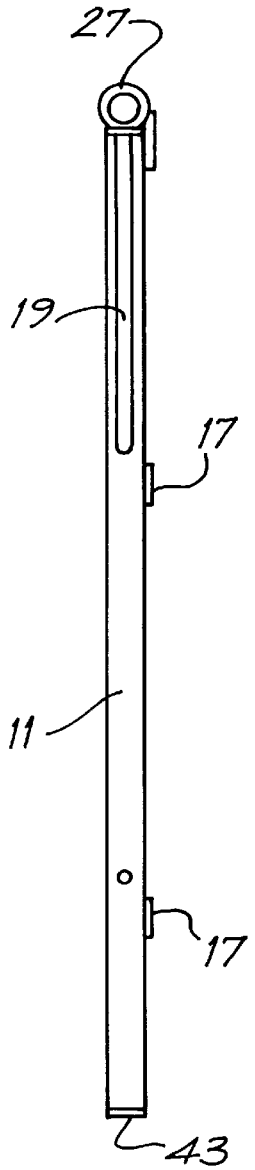
FIG. 6 is a schematic side elevational view of the support frame of FIG. 5.

In use, and with the chair in the unobtrusive, folded configuration as shown in FIG. 2, the push handle 39 is depressed such that the push bar 41 causes a downward movement of the mutually connected ends of levers 18. This causes pivoting of the levers about the axis of a fastener passing through pivot lugs 40. The distal ends of the levers 18 move upwardly so as to pull the pull rods 29 which in turn effect rotation of lock cams 32*a*, 32*b* and the release of striker pins 36 from the seat frame 13. This allows the chair to be configured in the in-use position whereas the striker pins 36 engage another aperture or recess in seat frame 13.

Figure 18:
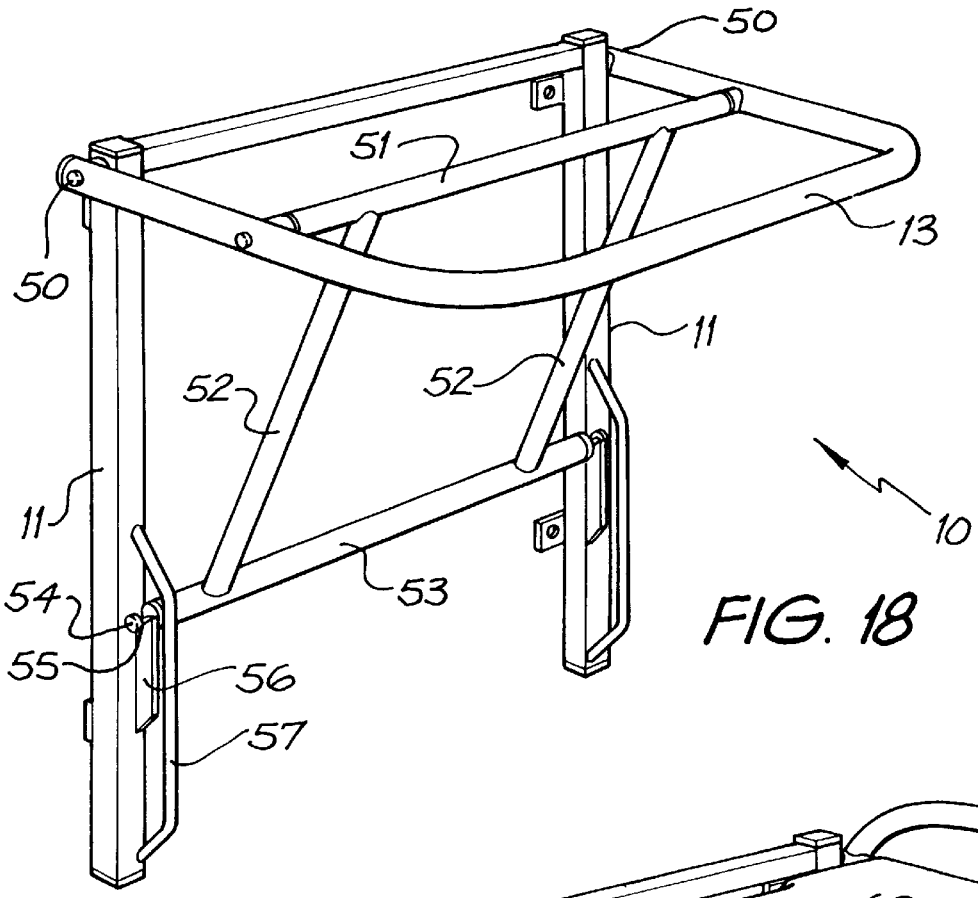
FIG. 18 is a schematic perspective view of the frame work of another foldable chair.
Figure 19:
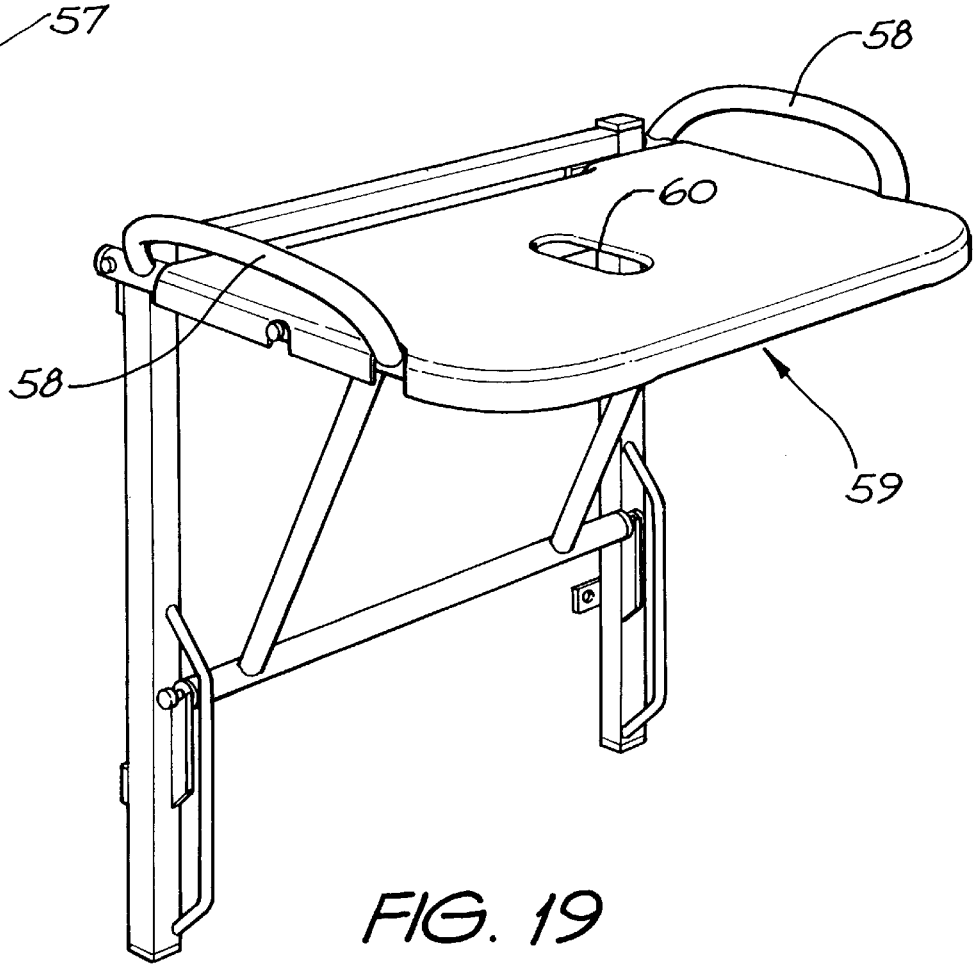
FIG. 19 is a schematic perspective view of yet another foldable chair.

In FIG. 18 of the accompanying drawings there is schematically depicted the framework of another chair 10. The framework 10 includes a pair of vertical posts 11 attachable to a wall and supportable upon the floor in the manner described above. The framework 10 also includes a seat support frame 13 pivotally connected at 50 to the vertical posts 11. The seat support frame 13 includes a cross brace 51 pivotally associated therewith. Depending from the cross brace 51 is a pair of seat supporting members 52 having a cross bar 53 extending between and laterally beyond the respective lower ends thereof. At each end of the cross bar 53 there is provided a boss 54 engagable with a slot 55 formed in a locking lug 56 welded or otherwise secured to each of posts 11. A guide bar 57 defines the limits of travel of boss 54 about locking lug 56. A similar foldable seat shown in FIG. 19 includes a seat 59 supported upon the seat frame 13. A pair of grab-handles 58 are welded or otherwise secured to the side members of the seat support frame 13. The seat 59 has a drain hole 60 therethrough. In use, the seat 59 is retained in a substantially horizontal configuration by interaction of the locking bosses 54 with the respective slots 55 formed in the lugs 56. In order to release the bosses 54 from their slots 55, the seat 59 and seat frame 13 can be lifted and then lowered such that the locking bosses pass through the space between the locking lug 56 and guide bar 57. In order to again lift the chair into the in-use configuration, the seat 59 and seat frame are lifted vertically such that the lugs 54 are guided by the guide bars 57 to a position above the slots 55 whereupon upward lifting force is released quickly and the bosses 54 fall into the slots 55. In order to clean and sanitize the seat 59, it may be removed from the seat frame upon which it is clipped in place. The clips (not shown) can be an integral part of the seat 59 adapted to snap-engage over the tubular members of the seat frame 13.

It should be appreciated that modifications and alterations obvious to those skilled in the art are not to be considered as beyond the scope of the present invention. For example, a different type of locking mechanism or actuation mechanism can be employed.

We claim:

1. A foldable chair configurable between a folded, substantially unobtrusive configuration to an in-use configuration, said chair including:

a support frame adapted to be secured to a wall, an arm rest pivotally connected to the frame, a seat frame connected to said support frame so as to pivot about a pivot axis which can move linearly along said support frame, an intermediate member pivotally connected to both said arm rest and said seat frame, a seat frame support member pivotally connected to both said seat frame and said support frame, and a locking mechanism for locking said seat frame in one or both of said configurations wherein said seat frame is essentially parallel with said support frame in said folded configuration and in said in-use configuration said seat frame is oriented so as to extend substantially normal to said support frame.

2. The foldable chair of claim 1, including a seat fixed to said seat frame and a back rest fixed to said support frame.

3. The foldable chair of claim 2, wherein said seat and back rest are formed of a PVC acrylic blend.

4. The foldable chair of claim 1, wherein said support frame has feet by which it can rest upon a floor such that said fasteners need not sustain shear stress.

5. The foldable chair of claim 1, wherein a roller is rotatably supported upon said seat frame and is adapted to roll within and engage against internal surfaces of vertical posts forming part of said support frame.

6. The foldable chair of claim 5, wherein two said vertical posts are provided, at least one of which has an elongate track or slot through which an axle of said roller passes from said seat frame to said roller.

7. The foldable chair of claim 1, wherein said intermediate member has a pair of seat frame support members attached to, so as to span laterally between, a pair of parallel and coextensive cross axle members, one of said cross axle members being pivotally connected at its ends to said support frame, the other of said cross axle members being pivotally connected at its ends to said seat frame.

8. The foldable chair of claim 1, wherein said locking mechanism comprises a lock mounted to said support frame and having a striker pin engagable with said seat frame.

9. The foldable chair of claim of claim 1, wherein said locking mechanism includes an actuator means comprising a push handle and connecting linkages connected to said push handle.

10. The foldable chair of claim 9, wherein said linkages include a pair of levers pivotally connected to said support frame and mutually, pivotally interconnected at one of their respective ends to said push handle, the other ends, each being pivotally interconnected to a respective pull rod.

11. The foldable chair of claim 10, wherein each said pull rod is pivotally connected to a lock cam which is associated with a striker pin engageable with said seat frame such that pulling of the pull rod causes rotation of said lock cam and movement of said striker pin.

12. The foldable chair of claim 1, wherein the components of said foldable chair are manufactured from 316 stainless steel.

13. The foldable chair of claim 1, wherein said support frame has fixing lugs by which the frame can be secured to a wall by fasteners.

* * * * *